United States Patent [19]

Hueschen et al.

[11] 4,185,365

[45] Jan. 29, 1980

[54] METHOD OF MAKING STATIONARY ANODE X-RAY TUBE WITH BRAZED ANODE ASSEMBLY

[75] Inventors: Robert E. Hueschen, Hales Corners; Richard A. Jens, Milwaukee, both of Wis.

[73] Assignee: General Electric Company, Schenectady, N.Y.

[21] Appl. No.: 940,700

[22] Filed: Sep. 8, 1978

[51] Int. Cl.[2] ..... H01J 9/18; H01J 35/08

[52] U.S. Cl. ..... 29/25.15; 313/55; 313/330

[58] Field of Search ..... 313/55, 330, 59; 29/25.15, 25.14; 228/180 R

[56] References Cited

U.S. PATENT DOCUMENTS

| | | | |
|---|---|---|---|
| 2,340,500 | 2/1944 | Zunick | 313/330 X |
| 2,381,625 | 8/1945 | Stewart | 29/25.14 |
| 2,688,709 | 9/1954 | Knochel et al. | 313/59 |
| 2,751,514 | 6/1956 | Atlee | 313/330 X |
| 4,109,058 | 8/1978 | Love et al. | 313/330 X |

OTHER PUBLICATIONS

Table 12.1 Brazing Filler Metals for Electron Tubes from *Materials and Techniques for Electron Tubes*, by W. H. Kohl, 1962, pp. 360–364.

*Primary Examiner*—Palmer C. Demeo
*Attorney, Agent, or Firm*—Ralph G. Hohenfeldt

[57] ABSTRACT

An anode assembly for a stationary anode x-ray tube wherein a tungsten target insert and an anode supporting metal sleeve are brazed simultaneously to the anode body. An axially tapered metal ferrule having a larger diameter than the sleeve is sealed into the end of a cylindrical glass envelope and the sleeve is inserted concentrically into the smaller end of the ferrule. The joint at the coterminous outside ends of the sleeve and ferrule is welded so as to seal and support the anode assembly in the tube envelope.

5 Claims, 3 Drawing Figures

METHOD OF MAKING STATIONARY ANODE X-RAY TUBE WITH BRAZED ANODE ASSEMBLY

This invention pertains to an anode assembly for use in a stationary target x-ray tube. Dental x-ray apparatus and x-ray analytical apparatus are illustrative of apparatuses in which stationary target x-ray tubes are used.

The conventional stationary target x-ray tube anode assemblies are made by vacuum casting copper around a prepared tungsten disk while the disk is in a mold made of heat refractory material. The casting is then machined and the tungsten target disk is ground to remove the copper overrun and to establish the desired angle of the target with respect to the axis of the cast anode body. A metal cup or sleeve having axially aligned end holes is sealed onto a short length of glass tubing. The metal sleeve is then brazed onto the cast anode body and the free end of the glass tube remains exposed. Subsequently, the end of the glass tube is sealed to a concentric portion of a glass envelope to complete construction of the x-ray tube.

This prior method of constructing a vacuum cast anode assembly involves many critical steps which require careful control. For instance, the tungsten target disk must be subjected to no more than 1200° C. during any part of the anode assembly manufacturing procedure or it will recrystalize and become vulnerable to fracturing or rupturing when it is heated to temperatures that prevail in an operating x-ray tube. The tungsten disk must also be precoated on at least its bottom and sides with copper to inhibit formation of voids and obtain a continuous adherent interface during the casting operation. A piece of boron-deoxidized copper alloy must also be placed behind the tungsten target disk during casting to prevent (1) voids from forming behind the disk, which would decrease heat flow to the copper anode, and (2) the formation of large grains of copper adjacent the disk. Large grains could cause vacuum leaks.

Making of the glass-to-metal seal between the anode supporting sleeve and the short glass tube is also problematical. The metal cup or sleeve requires a copper coating prior to it being sealed to the glass tube. The copper coating has been found necessary up to this time to obtain a good braze joint between the sleeve and the copper anode body. The copper coating, however, has a tendency to migrate or creep into the glass at the seal area so copper must be carefully removed from this area before joining it to the glass. Nevertheless, leaky seals due to copper contamination in the glass commonly occur. Moreover, when the sleeve with the short glass tube sealed to it is brazed to the anode body in a hydrogen induction furnace, the amount of heat required to melt the braze alloy sometimes results in destruction of the glass-to-metal seal. This prior art method of making the anode assembly and sealing it in a glass tube envelope has an accumulation of problems which result in production line yield of initially satisfactory x-ray tubes being lower than desired.

SUMMARY OF THE INVENTION

A primary object of this invention is to provide a method of making a stationary target x-ray tube which overcomes the above-mentioned problems and results in a higher yield of satisfactory x-ray tubes during manufacture.

In particular, an object is to provide a method for brazing the tungsten x-ray target to the copper anode body without danger of raising the tungsten target above its recrystallization temperature and also to circumvent the problems of the glass-to-metal seals which arise in the prior art method. Specifically, the new method avoids the need for copper coating the anode body supporting sleeve or cup and it avoids brazing the anode in the presence of a glass-to-metal seal.

Briefly, the new method involves machining a cylindrical anode body from an oxygen-free high conductivity copper rod. An end of the body is then machined at an angle relative to its axis and corresponding with the desired target angle. A circular recess is then machined in the angulated end face of the body. The opposite end of the body has its diameter reduced to form an axially extending stem. A concentric shoulder is formed on the body for receiving an anode supporting sleeve or cup. A tungsten target disk is then set in the end face recess with a thin foil of brazing alloy behind it. A ring of brazing alloy is also placed at the joint between the sleeve and the anode body. This assembly is then placed in a holder which has a cylindrical bore and a closed bottom. The holder has a projection in its bottom against which the target disk presses. The holder keeps all parts of the anode assembly aligned and in proper position. The holder containing the anode assembly is then placed in an oxygen-free furnace and heated to a temperature sufficient to fuse the brazing ring and foil. After cooling, the anode assembly is ready for being installed in a glass tube envelope by making a weld between the end of the sleeve and a ferrule which has already been sealed into the glass envelope.

How the foregoing and other more specific objects of the invention are achieved will be evident in the following more detailed description of the new stationary anode x-ray tube structure and method of making it which will now be set forth in reference to the drawing.

DESCRIPTION OF A PREFERRED EMBODIMENT

Figure 3:
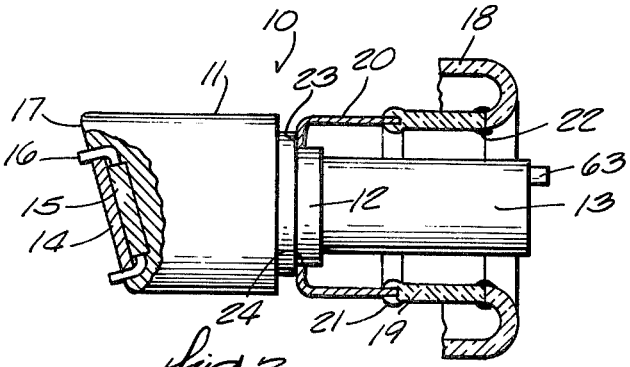
Fig. 3 PRIOR ART
FIG. 3 shows a prior art anode assembly with a part of the x-ray tube envelope shown and other parts of the envelope and tube omitted.

Attention is invited first to FIG. 3 which serves as a basis for describing how a prior art stationary anode x-ray tube was made and for illustrating some of the problems associated with the method.

In FIG. 3 the previously cast and machined anode body 10 is seen to comprise a cylindrical portion 11, a diametrically reduced portion 12 and an integral stem 13. Anode body 10 is machined, of course, after it has been cast from oxygen-free high conductivity copper. Anode body 10 is cast in a cylindrical closed body mold, not shown. A tungsten target disk 14 is secured in the center and bottom of the mold and a copper alloy disk 15 is secured behind and onto it during molding. Disk 15 has been found necessary in the past to effect good bonding between tungsten target disk 14 and the cast copper body 11. Disk 15 is composed of boron-deoxidized copper which is not easy to obtain. Copper disk 15 is maintained in central alignment with tungsten target disk 14 with several hook-shaped molybdenum pins 16 which bond to the cast metal. When disks 14 and 15 and pins 16 are fixed in the bottom of the mold, the mold is placed in a vacuum resistance heating furnace and oxygen-free high conductivity copper is melted drop by drop into the mold to form the rough anode casting. The angulated end surface 17 of the body is then ground to remove any overrun of copper from the surface of tungsten target 14 and to make the pins 16 flush if any part of them projects after casting. The cast body is then machined to produce the shouldered reduced diameter portion 12 and the stem 13 which is used to support the x-ray tube and provide an external electrical connection to the anode.

The tungsten target disk 14, prior to it having the anode body cast on it, must be precoated with a thin layer of copper before casting or it will not bond to the cast copper. The coating has been obtained by painting copper oxide on the target disk and firing it in a hydrogen furnace to reduce the copper oxide to copper. The new method to be described avoids this step.

Referring further to FIG. 3, one may see that the anode body must be supported in a glass envelope of the x-ray tube. The curved end portion of the glass envelope is shown fragmentarily and is marked 18. The anode body 10 is sealed to tube envelope 18 by means of a glass tube segment 19 that has been previously sealed to a sleeve 20 which, in this example, is cup-shaped. The short length of glass tube 19 must be sealed to metal sleeve 20 as it is at the glass-to-metal seal joint 21 prior to these two parts being joined with tube envelope 18 by means of a glass-to-glass seal 22. Sleeve 20 is joined to anode body 10 by causing brazing metal to fuse between its end 23, its edge 24 and the shouldered cylindrical portion 12 of the anode body.

Sleeve 20 has generally been made of metal identified by the trademark Kovar which is a well-known iron, cobalt and nickel alloy which desirably has about the same thermal coefficient of expansion as borosilicate glass. Other tradenames for a similar alloy are Rodar and Therlo. In the prior art method, a copper coating must be applied to at least the portions of sleeve 20 which are involved in a braze joint or an imperfect braze will be obtained. As explained earlier, this copper coating has a tendency to migrate into the glass-to-metal seal or joint 21 and produce leakiness in the joint. Avoiding the use of this coating, as in the new method which will be explained, is desirable.

A disadvantage of the prior art method is that a short glass tube section such as 19 must be joined to metal sleeve 20 before the metal sleeve is brazed to anode body 10 so that there will be access to the region where glass-to-glass seal 22 is produced for fixing the anode assembly in glass envelope 18. Unfortunately, when the whole anode assembly is raised to a temperature high enough to effect the braze at the interfaces 23 and 24 of sleeve 20 with the anode body, the temperature must be carefully controlled to avoid deforming the glass 19. Thus, it will be seen that the prior art procedure for making and installing a stationary anode assembly in a tube envelope presents one problem after another which have an unfavorable effect on the quality of the product and which increase the cost and complexity of production.

Figure 1:
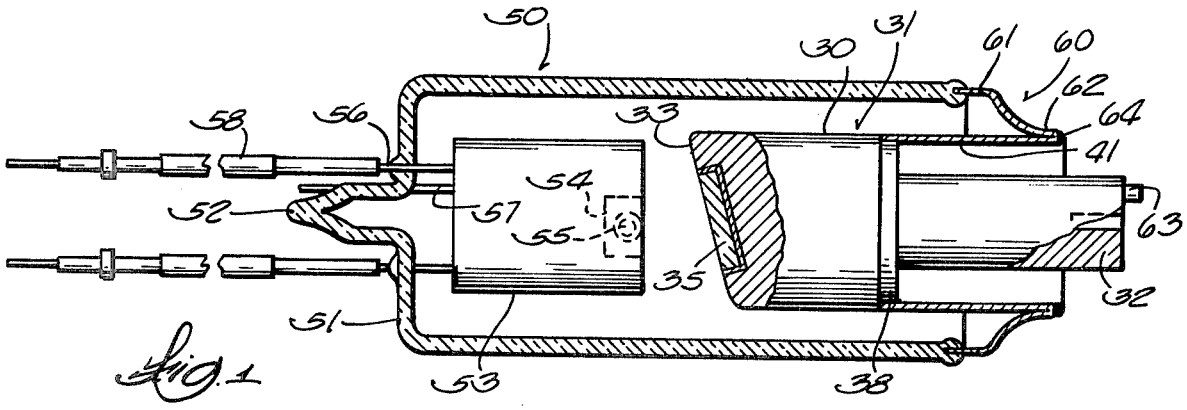
FIG. 1 is a stationary anode x-ray tube, partly in section, made in accordance with the invention.

A stationary anode x-ray tube made in accordance with the new method and construction is shown in FIG. 1. Before discussing this final assembly, however, making of the anode assembly will be explained in reference to FIG. 2.

Figure 2:
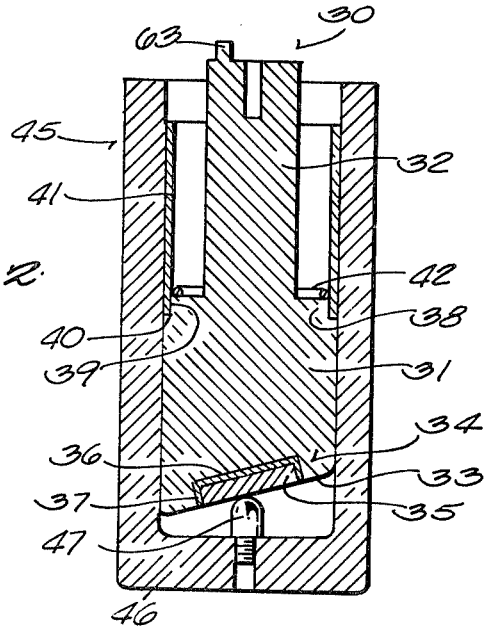
FIG. 2 is a longitudinal section of the new anode assembly in a holder as it appears before the brazing operation is completed.

In FIG. 2, development of the anode assembly 30 has been carried on to the point where it is ready for having its parts brazed together. The anode body comprises two main integral parts, a cylindrical portion 31 and a coaxial stem portion 32. It is assumed that the anode 30 has been previously machined from oxygen-free high conductivity copper so that the cylindrical portion 31 and stem 32 have the proper finish and diameters. A transversely extending end surface 33 of the anode body has been machined so this surface is at an angle with respect to the intersecting axis of the anode body. A circular recess 34 is also milled in end surface 33. A target disk 35, preferably of tungsten, is disposed in recess 34. A thin disk or foil 36 composed of a copper and gold or nickel and gold alloy has been inserted behind tungsten target 35. As shown, the thickness of this foil is exaggerated. Generally, foil having a thickness of about 0.003 inch is desirable. As shown, there is an annular free space 37 surrounding target disk 35 but the thickness of this space is exaggerated in the drawing for the sake of clarity. When the anode body is ultimately heated sufficiently to melt foil 36 and effect brazing of the tungsten target disk 35 in recess 34, the brazing metal will have migrated along the edges of the target so as to fill the annular gap 37. In a practical case, the diameter of target disk 35 is held to a tolerance of about $\pm 0.001$ inch relative to the diameter of recess 34. Thus, disk 35 fits rather snugly into recess 34, even before brazing has been done.

The anode body 30 in FIG. 2 is also machined to have a reduced diameter region 38 which defines a cylindrical surface 39 and a shoulder 40. A tubular sleeve 41 is placed concentrically on cylindrical portion 38 so that one end of the sleeve abuts shoulder 40 to position the sleeve properly. Sleeve 41 may be made of an iron base alloy such as Kovar, Rodar or Therlo or it can be made of stainless steel. Stainless 304 has been used successfully. This sleeve may also have the configuration of sleeve 20 in FIG. 3 where the sleeve is more like a cup that has a perforated bottom. Sleeve 41 is joined to cylindrical anode body 31 by brazing.

For the purpose of brazing, a copper and gold or nickel and gold alloy wire ring 42 is placed concentrically with the inside of sleeve 41, as shown in FIG. 2, adjacent the joint that is formed between the sleeve and anode body. When the anode 30 has sleeve 41 assembled to it and has brazing ring 42 and target 35 and brazing foil 36 in place as shown in FIG. 2, the assembly is inserted in a cylindrical container 45 which has a closed bottom 46 which can be made of stainless steel or other refractory material. The bottom of the container 45 has a stud 47 projecting upwardly from it so that when the anode body 30 is put in the container, the weight of the anode assembly reacting against the stud will prevent tungsten target disk 35 from falling out of recess 34. The smooth continuous inside bore of container 45 will, of course, maintain sleeve 41 concentric with anode body 30.

After the parts of the anode are preassembled as in FIG. 2, the container 45 with the anode in it is placed in a hydrogen filled furnace and heated for a sufficient length of time to raise the temperature of the anode body and its associated parts at least to 1000° C. and not in excess of 1083° C. In any event, the assembly should not be heated to exceed the recrystallization temperature of tungsten, if that is the target material that is used.

Heating at above 1000° C. causes the copper and gold alloy foil disk 36 to melt and flow or migrate along the periphery of target disk 35 to effect brazing of the disk into recess 34. At the same time, the copper and gold or nickel and gold alloy brazing ring 42 melts and, due to capillary action, this metal migrates along the joint between the interior of sleeve 41 and reduced diameter portion 39 and shoulder 40 on the cylindrical portion 31 of the anode body. This results in a solid braze being formed. Thus, both sleeve 41 and tungsten target 35 are brazed in one manufacturing operation.

Kovar and similar alloys were indicated as being the material for sleeve 41 in the description of the assembly in FIG. 2 but sleeve 41 can also be made of stainless steel which can be just as effectively brazed to the anode body 30 with copper and gold or nickel and gold alloy brazing materials.

The brazed anode assemblies made as just described in reference to FIG. 2 are installed in x-ray tube envelopes as will now be explained in reference to FIG. 1.

FIG. 1 shows an x-ray tube in which the brazed stationary target anode assembly is installed. It comprises a cylindrical or tubular glass envelope which is generally designated by the reference numeral 50. The envelope has a closed end 51 from which a tubulation 52 extends that is used for evacuating and sealing the x-ray tube after it is assembled. A preliminary step to final assembly of the tube is to install the cathode structure which is symbolized by the cylinder marked 53. The cathode structure may be of conventional design. It has a recess or focusing cup 54 in which there is an electron emissive filament coil 55 which provides the electron beam that impinges on tungsten target 35. Cathode structure 53 is supported on wires such as those marked 56 and 57. These wires are sealed into the closed end 51 of the envelope using convention metal-to-glass sealing methods. Some of the wires have insulation 58 for facilitating mounting them in an oil filled x-ray tube housing or casing in a well-known fashion.

The tubular glass envelope 50, in accordance with the invention, has a ferrule sealed in its end which is open until final assembly of the tube. This ferrule is characterized by having a large diameter portion 61 converging down to a small diameter portion 62. This tapered ferrule is so shaped to reduce the stress on the glass seal to prevent strain from being developed in the glass during processing. Ferrule 60 is made of Kovar or the like since this alloy metal has a coefficient of expansion which matches that of the glass envelope 50. The large diameter portion 61 of the ferrule is sealed into the end of envelope 50 by traditional glass-to-metal sealing methods. The small diameter end 62 is open until anode assembly 31 is inserted in it.

As shown in FIG. 1, the anode assembly is inserted into tube envelope 50 until the outer end of anode supporting sleeve 41 is coterminous with the outer end of annular ferrule 60. At this time, the x-ray tube is in a jig, not shown, which uses an indexing pin 63 to assure that the angular end surface 33 of the anode assembly is properly oriented for ultimately being installed in an x-ray tube housing. The anode assembly 31 is then finally sealed into envelope 50 by welding reduced diameter end 62 of the ferrule and the free end of anode supporting sleeve 41 along the joint that is formed where they end coterminously. The annular weld is marked 64. The weld is preferably made by the well-known TIG or tungsten-insert gas method.

It should be appreciated that no glass sealing work has to be done between the tube envelope and the anode supporting sleeve 41 to obtain the assembly depicted in FIG. 1. The heat developed by the weld joint 64 is highly localized so it has no adverse effect on any glass-to-metal seals. No copper coating has been required on the sleeve 41 or ferrule 60. All assembly operations require work which is out in the open and, therefore, is easy to get at. No work has to be done in close fitting places as in prior art assembly methods. The danger of having coating metals migrate into glass-to-metal seals and cause vacuum leaks is eliminated. None of the parts ever need to be subjected to a temperature which would be so high as to adversely affect any of the other parts of the tube at any time during the anode preassembly steps nor the final tube assembly steps.

It should be noted that when the option of making anode supporting sleeve 41 of stainless steel is exercised, ferrule 60 must still be made of Kovar. These two metals are compatible for welding with the TIG method.

We claim:

1. A method of making an anode assembly for a stationary anode x-ray tube comprising the steps of:

providing a cylindrical metal anode body that has a planar end surface which crosses the cylinder axis at an angle, that has a recess in said planar end surface for accommodating an x-ray target element flush with said end surface, that has an annular shoulder axially spaced from said end surface, and that has an electrical connecting member projecting integrally and axially from said body in a direction opposite from said end surface, assembling a tubular anode support element having opposite open ends and composed of an iron based alloy concentrically onto said body so one end of said tubular element abuts said shoulder, disposing a ring of copper-and-gold or nickel and gold alloy brazing metal around the joint created between said one end of said tubular element and said body, setting a tungsten x-ray target element in said recess with a copper-and-gold or nickel and gold alloy foil of brazing metal intervening between said target element and the interior of said recess, retaining the foregoing assembly in a cup which has a closed bottom, an open top, a bore for receiving said cylindrical body snugly and which has a projection extending from said bottom against which said target element presses, and raising the temperature of said cup and assembly to between 1000° C. and 1083° C. for sufficient time to melt said ring of brazing metal and said foil and thereby bond said target element and said tubular element to said cylindrical body.

2. The method set forth in claim 1 including the further steps of coupling said anode assembly with the glass envelope of an x-ray tube, comprising:

forming a glass envelope with a tubular portion having an inside diameter greater than the outside diameter of said tubular anode support element and having an open end, using a metal ferrule which is shaped to have opposed large diameter and smaller diameter ends and sealing said large diameter end into the open end of said glass envelope, inserting said tubular anode support element into said ferrule until the end of said tubular element is substantially flush with said smaller diameter end of said ferrule, and welding the ends of said ferrule and said tubular element together.

3. The method as in claim 2 wherein said tubular anode support element is composed of stainless steel.

4. The method as in claim 2 wherein said ferrule and said tubular anode supporting element are composed of an iron based alloy including cobalt and nickel.

5. The method as in claim 2 wherein the tungsten-inert gas method is used for welding said ferrule and tubular anode support element.

* * * * *